US006522859B1

(12) United States Patent
Chappell

(10) Patent No.: US 6,522,859 B1
(45) Date of Patent: Feb. 18, 2003

(54) FIBER REMOVAL DEVICE

(75) Inventor: James M. Chappell, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/981,179

(22) Filed: Oct. 16, 2001

(51) Int. Cl.[7] ..... G03G 21/00
(52) U.S. Cl. ..... 399/343; 15/345; 399/98
(58) Field of Search ..... 399/98, 99, 92, 399/343, 349; 15/300.1, 345

(56) References Cited

U.S. PATENT DOCUMENTS 4,026,701 A * 5/1977 Till et al. ..... 15/345 X
5,321,484 A * 6/1994 Kedarnath et al. ..... 15/256.51
5,577,294 A * 11/1996 Pollock ..... 15/345
6,181,896 B1 * 1/2001 Zirilli et al. ..... 399/98 X

FOREIGN PATENT DOCUMENTS

JP 08-195458 * 4/1996

* cited by examiner

*Primary Examiner*—Sophia S. Chen
(74) *Attorney, Agent, or Firm*—Lloyd F. Bean, II

(57) ABSTRACT

An air suction manifold device for removal of fibers/debris from the photoreceptor surface, which may otherwise attach to the development electrode wires causing a print defect(s). The device incorporating a secondary channel perpendicular to the main channel, formed by the manifold flange(s) proximity to the photoreceptor surface. The secondary channel supplying a specific volume of air at a specific mean velocity in a direction perpendicular to the flow direction of the main channel. The volume and velocity of secondary channel air being of such magnitude that it crosses the main channel gap and impinges on the photoreceptor surface, causing a zone of maximum shear stress prior to completely mixing with the main channel air. The maximum sheer stress zone resulting in improved fiber/debris removal performance from the photoreceptor surface.

10 Claims, 5 Drawing Sheets

FIG. 2

FIBER REMOVAL DEVICE

BACKGROUND OF THE INVENTION

This invention relates generally to electrophotographic printing, and more particularly, concerns cleaning imaging (i.e. photoreceptive, photoconductive, etc.) and bias transfer roll (BTR) surfaces using air velocity.

High velocity air streams have been used to clean photoreceptors in the past. Although several attempts have been made to clean photoreceptors and bias transfer rolls (BTRs). These devices, photoreceptors and BTRs, have used air knives to create a high velocity air stream to clean their surfaces. Such devices can consist of a plate, closely spaced to the surface to be cleaned, with narrow slots cut into it. A vacuum is applied behind the plate to cause air to flow through the slots and create a high velocity airstream across the surface being cleaned. The high velocity air flow disturbs the surface boundary layer allowing removal of particles adhered to the surface.

The problems with this approach are in the manufacture of the device and the power required to create the vacuum. The tolerances for the cleaner and the surface to be cleaned must be held closely. The orifice slot width must be uniform along its length to maintain uniform air velocities and therefore cleaning. The spacing between the plate and surface to be cleaned must also be uniform for the same reasons. This requires the plate and cleaning surface to be straight, flat and well aligned. If the surface to be cleaned is a roll, the runout of the roll and the parallelism of the roll axis to the slot axis is also important. Because of the close spacing of the cleaning plate to the surface to be cleaned and the narrow orifice slot, the resistance of the system to air flow is very high.

As a result of this high resistance to air flow, a considerable air flow is required to generate the required cleaning air velocities needed for the narrow orifice slot to clean the surface. The requirements of high pressure and air flow result in a high power usage for the system and the possibility of a noise problem.

An object of the fiber removal device which can remove fiber before fiber can interfere with development wires associated with HSD development systems thereby reducing fiber related streak defects.

There is provided an air suction manifold device for removal of fibers/debris from the photoreceptor surface, which may otherwise attach to the development electrode wires causing a print defect(s). The device incorporating a secondary channel perpendicular to the main channel, formed by the manifold flange(s) proximity to the photoreceptor surface. The secondary channel supplying a specific volume of air at a specific mean velocity in a direction perpendicular to the flow direction of the main channel. The volume and velocity of secondary channel air being of such magnitude that it crosses the main channel gap and impinges on the photoreceptor surface, causing a zone of maximum shear stress prior to completely mixing with the main channel air. The maximum sheer stress zone resulting in improved fiber/debris removal performance from the photoreceptor surface.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 5 printing machine will be shown hereinafter schematically and their operation described briefly with reference thereto.

Figure 5:
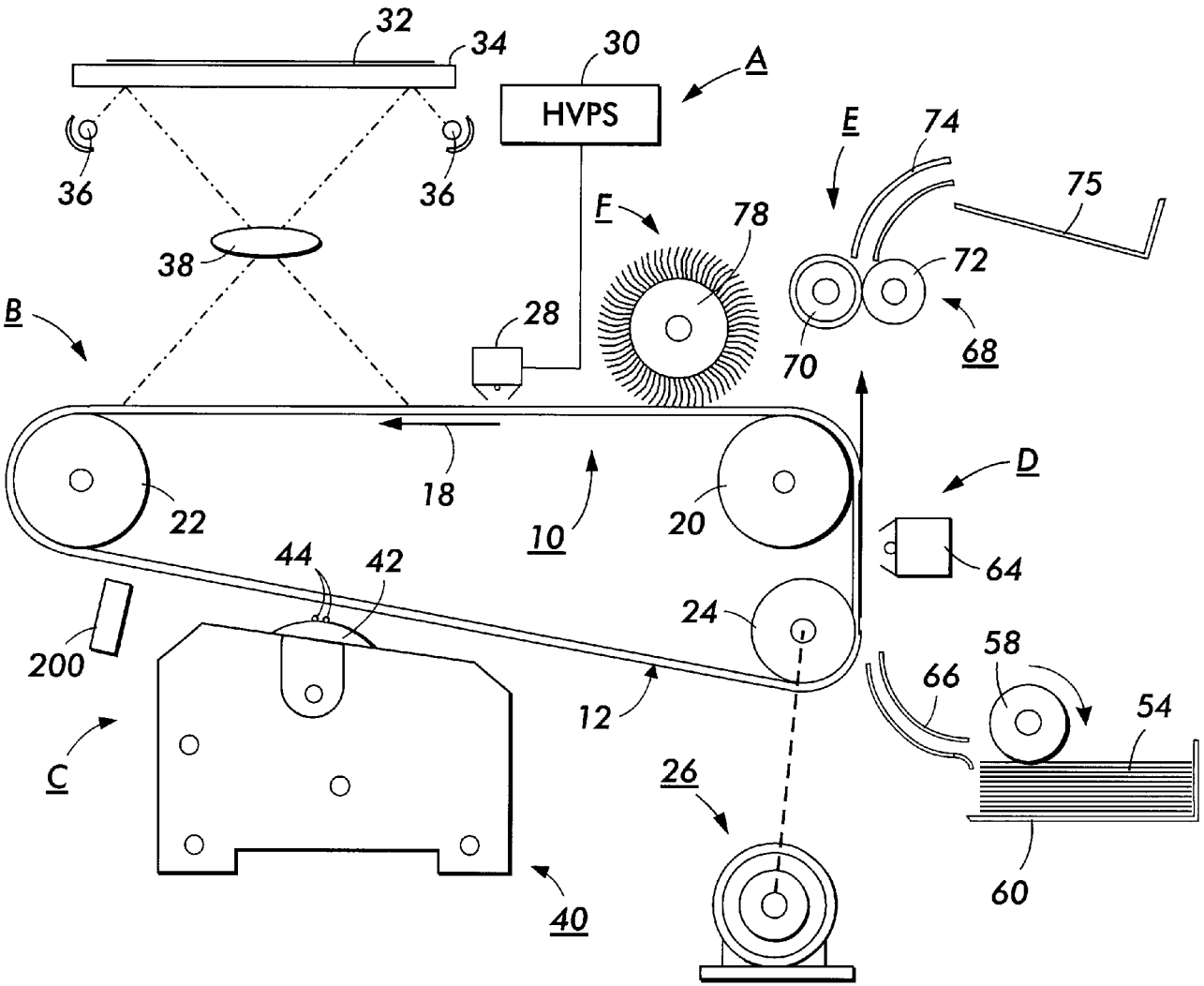
FIG. 5 is a schematic elevational view of an illustrative electrophotographic printing machine incorporating the features of the present invention therein.

Referring initially to FIG. 5, there is shown an illustrative electrophotographic printing machine incorporating the development apparatus of the present invention therein. The electrophotographic printing machine employs a belt 10 having a photoconductive surface 12 deposited on a conductive substrate. Preferably, photoconductive surface 12 is made from selenium alloy. Conductive substrate is made preferably from an aluminum alloy that is electrically grounded. One skilled in the art will appreciate that any suitable photoconductive belt may be used. Belt 10 moves in the direction of arrow 18 to advance successive portions of photoconductive surface 12 sequentially through the various processing stations disposed of throughout the path of movement thereof. Belt 10 is entrained about stripping roller 20, tensioning roller 22 and drive roller 24. Drive roller 24 is mounted rotatably in engagement with belt 10. Motor 26 rotates roller 24 to advance belt 10 in the direction of arrow 18. Roller 22 is coupled to motor 26 by suitable means, such as a drive belt. Belt 10 is maintained in tension by a pair of springs (not shown) resiliently urging tensioning roller 22 against belt 10 with the desired spring force. Stripping roller 20 and tensioning roller 22 are mounted to rotate freely.

Initially, a portion of belt 10 passes through charging station A. At charging station A, a corona generating device, indicated generally by the reference numeral 28 charges photoconductive surface 12 to a relatively high, 20 substantially uniform potential. High voltage power supply 30 is coupled to corona generating device 28 to charge photoconductive surface 12 of belt 10.

After photoconductive surface 12 of belt 10 is charged, the charged portion thereof is advanced through exposure station B.

At exposure station B, an original document 32 is placed face down upon a transparent platen 34. Lamps 36 flash light rays onto original document 32. The light rays reflected from original document 32 are transmitted through lens 38 to form a light image thereof. Lens 38 focuses this light image onto the charged portion of photoconductive surface 12 to selectively dissipate the charge thereon. This records an electrostatic latent image on photoconductive surface 12 that corresponds to the informational areas contained within original document 32.

After the electrostatic latent image has been recorded on photoconductive surface 12, belt 10 advances the latent image to development station C. On the way to development station C the latent image passes under fiber removal device 200 of the present invention which removes fibers adhering to the imaging surface. Alternatively fiber removal device can be positioned prior to the exposure station B.

At development station C, a developer unit, indicated generally by the reference numeral 40, develops the latent image recorded on the photoconductive surface. Preferably, developer unit 40 includes donor roll 42 and electrode wires 44. Electrode wires 44 are electrically biased relative to donor roll 42 to detach toner therefrom so as to form a toner powder cloud in the gap between the donor roll and the photoconductive surface. The latent image attracts toner particles from the toner powder cloud forming a toner powder image thereon. Donor roll 42 is mounted, at least partially, in the chamber of developer housing. The chamber in developer housing stores a supply of developer material. In one embodiment the developer material is a single component development material of toner particles, whereas in another the developer material includes at least toner and carrier.

With continued reference to FIG. 5, after the electrostatic latent image is developed, belt 10 advances the toner powder Image to transfer station D. A copy sheet 54 is advanced to transfer station D by sheet feeding apparatus. Preferably, sheet feeding apparatus includes a feed roll 58 contacting the uppermost sheet of stack 60 into chute 66. Chute 66 directs the advancing sheet of support material into contact with photoconductive surface 12 of belt 10 in a timed sequence so that the toner powder image developed thereon contacts the advancing sheet at transfer station D. Transfer station D includes a corona generating device 64 which sprays ions onto the back side of sheet 54. This attracts the toner powder image from photoconductive surface 12 to sheet 54. After transfer, sheet 54 continues to move in the direction of arrow onto a conveyor (not shown) that advances sheet 54 to fusing station E.

Fusing station E includes a fuser assembly, indicated generally by the reference numeral 68, which permanently affixes the transferred powder image to sheet 54. Fuser assembly 68 includes a heated fuser roller 70 and a back-up roller 72. Sheet 54 passes between fuser roller 70 and back-up roller 72 with the toner powder image contacting fuser roller. In this manner, the toner powder image is permanently affixed to sheet 54. After fusing, sheet 54 advances through chute 74 to catch tray 75 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 78 in contact with photoconductive surface 12. The particles are cleaned from photoconductive surface 12 by the rotation of brush 78 In contact therewith. Subsequent to cleaning, a discharge lamp (not shown) floods photoconductive surface 12 with light to dissipate any residual electrostatic charge remaining thereon prior to the charging thereof for the next successive imaging cycle.

Figure 1:
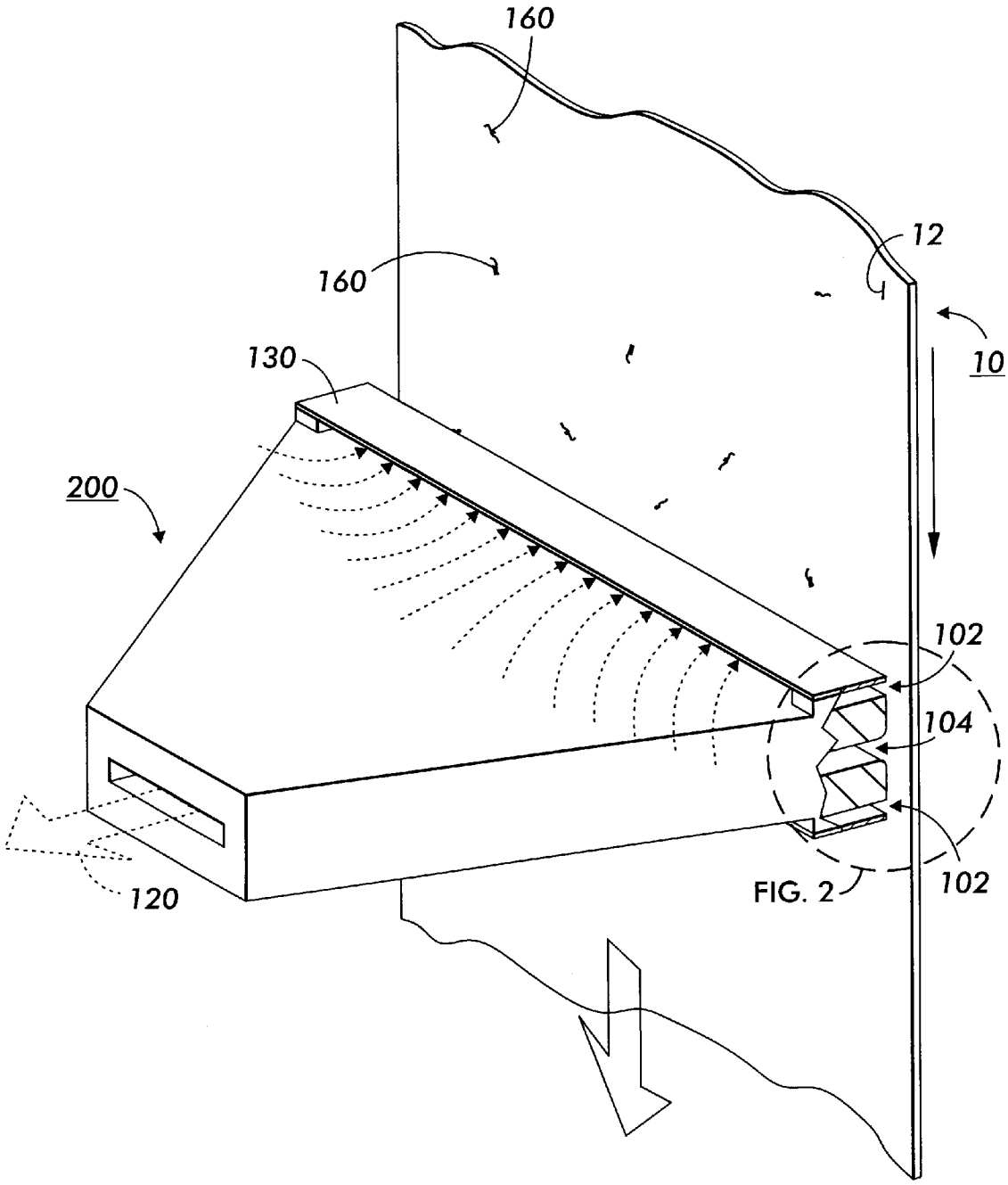
FIG. 1 is a schematic of the air manifold housing of the present inventions

Reference is now made to the drawings where the showings are for the purpose of illustrating a preferred embodiment of the invention and not for limiting same. Referring now to FIG. 1, fiber removal device which shows tangential air flow created by a vacuum source (e.g. pump, blower, fan) (not shown) through housing 200. The present invention draws air under manifold surface 130, by the use of a vacuum shown by the arrow 120, created by the vacuum source, inside the housing 200, to create the high velocity air needed to disturb the surface boundary layer and remove adhered particles. The flanges 130 are automatically spaced above the surface to be cleaned 12 (i.e. imaging surface or BTR surface). With the use of these manifold surface 130, very small gaps can be easily created which will generate high air flows 140 tangent to the surface to be cleaned with relatively small air flows. The very small gaps under the manifold surface 130 insure that the boundary layer is penetrated by the air stream and that the air velocity is high.

Figure 2:
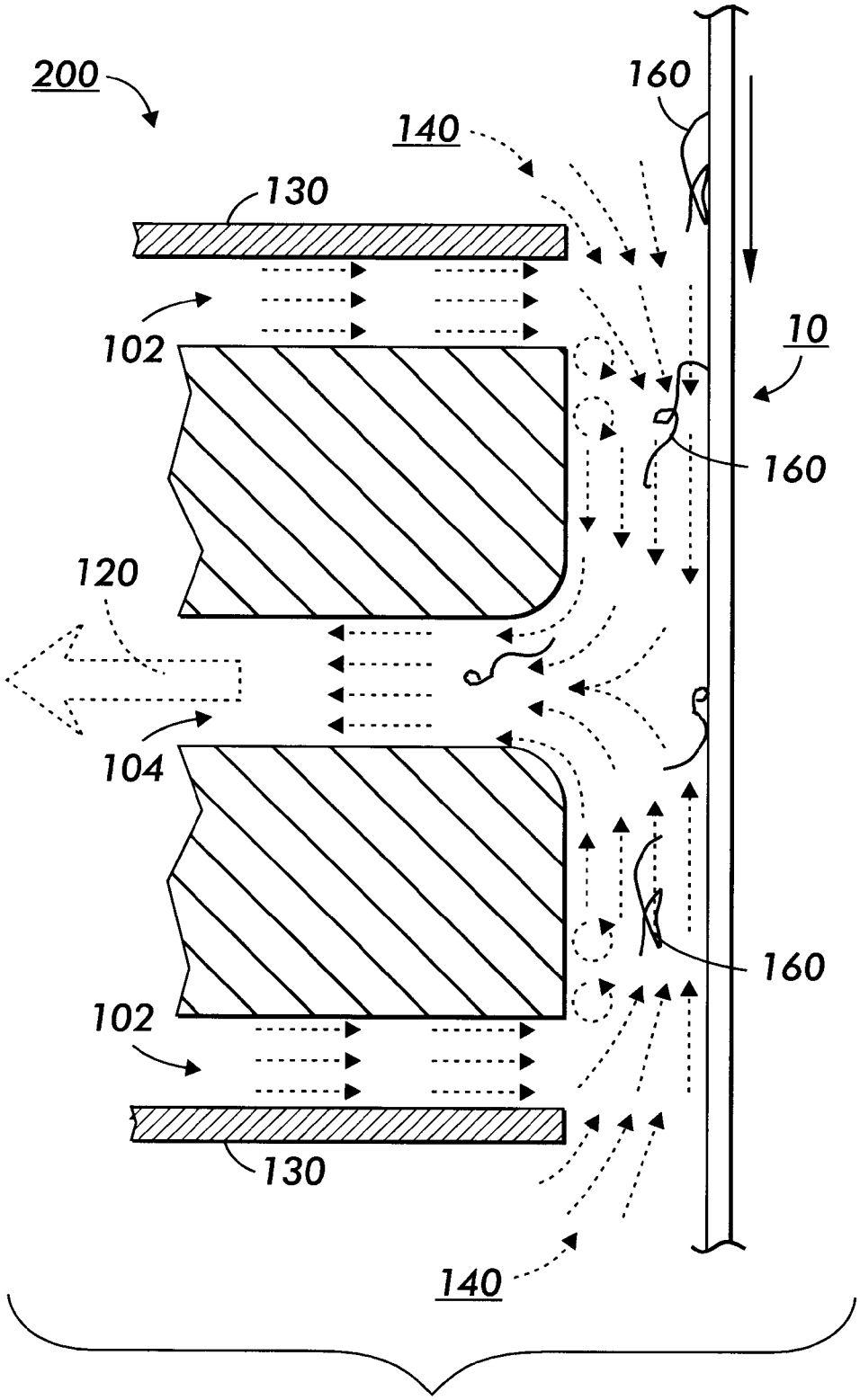
FIG. 2 is an enlarged side view of the air manifold housing of the present invention.

FIG. 2 illustrates an enlarged side view of housing 200 of the present invention. Housing 200 has a primary channel 104; a second channel 102 which is parallel to the primary channel 104. The primary channel 104 and secondary channel 102 are adjacent to each other. In operation, vacuum 120 creates the high velocity air needed to disturb the surface boundary layer and remove adhered particles to the surface to be cleaned by drawing air through a particle primary channel 104 and secondary channels 102. Air flowing through primary channel 104 and secondary channels 102 generate high air flows 140 tangent to the surface to be cleaned.

Figure 3:
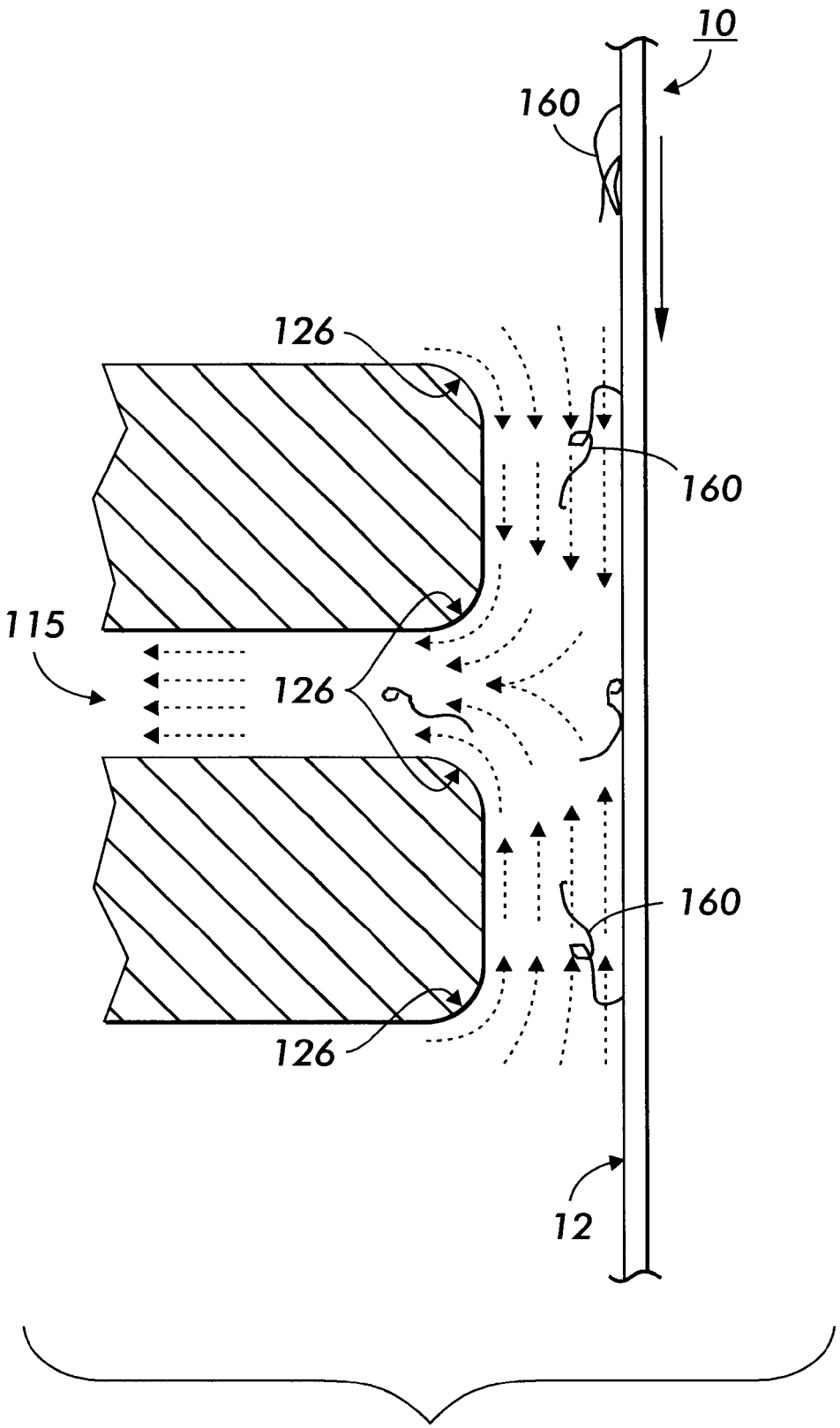
FIG. 3 is an enlarged side view of the air manifold housing having a single channel with a with flange having a rounded edge.
Figure 4:
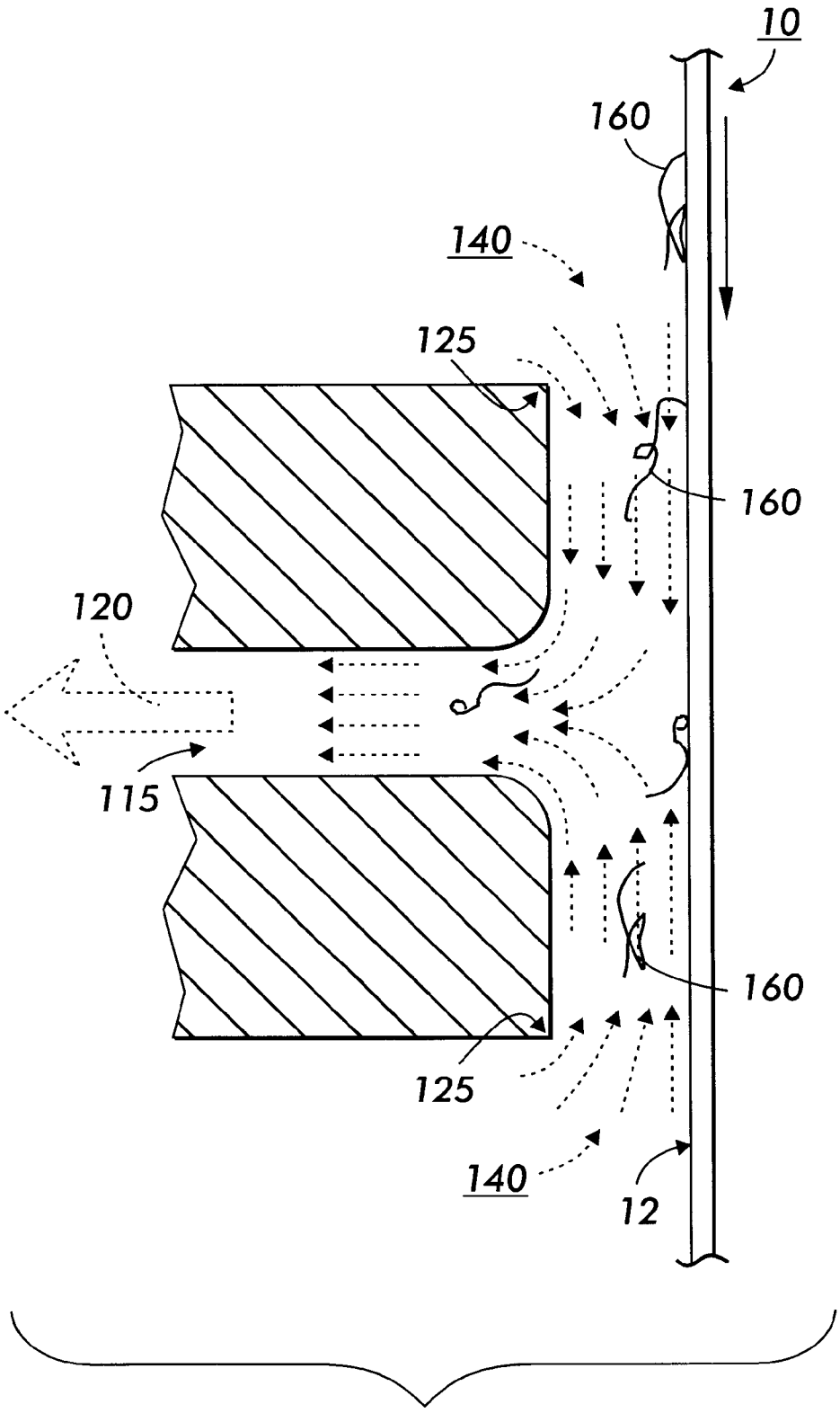
FIG. 4 is an enlarged side view of the air manifold housing having a single channel with a flange having a sharp edge.

Applicant has performed bench testing on embodiments shown in FIGS. 2–4. FIG. 3 shows a manifold housing employing a single channel 115. Single channel 115 has a flange having a rounded corners 126 facing the surface to be cleaned. Applicant has found more air is required to dislodge the particles 160 and allow other forces to transport the particles 160 away from the surface 12 when compared to embodiments shown in FIGS. 4 and 2.

FIG. 4 shows a manifold housing employing a single channel 115. Single channel 115 has a flange having a sharp corner 125 facing the surface to be cleaned. Applicant has found that more air is required to dislodge the particles 160 and allow other forces to transport the particles 160 away from the surface 12 when compared to embodiment shown in FIG. 2. But applicant has found better sheer stress was generated to dislodge the particles with the sharp corner as compared to embodiment shown in FIG. 3.

Applicant has found less air flow is required to dislodge the particles 160 and allows reduced vacuum force to transport the particles 160 away from the surface 12 when compared to embodiments shown in FIGS. 3 and 4.

Applicant has found through laboratory testing that in addition of the secondary channel perpendicular to the main channel formed by the manifold flange(s) proximity to the photoreceptor surface, results in improved particle removal performance from the photoreceptor surface. The secondary channel supplying a specific volume of air at a specific mean velocity in a direction perpendicular to the flow direction of the main channel. The vacuum generated through the primary channel generated a volume and velocity of air through the secondary channels so that air therethrough crosses the primary channel gap and impinges on the photoreceptor surface, causing a zone of maximum shear stress prior to completely mixing with the main channel air. Extensive numerical simulation research suggests that maximizing the shear stress zone results in improved particle removal performance from the photoreceptor surface. The performance improvement provides decreased power requirements, as well as increased latitude for bulk air flow and channel height (gap) requirements.

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

What is claimed:

1. An apparatus for removing particles from a surface, comprising:

a manifold including a primary channel having a first opening facing the surface;

a secondary channel having a second opening facing the surface, said secondary channel being parallel to the primary channel; said secondary channel has flange having a sharp corner facing the surface; and vacuum means, in communication with said primary and coating with said secondary channel, for generating high velocity air stream to disturb a boundary layer of the surface thereby removing adhered particles from the surface.

2. The apparatus of claim 1 wherein said secondary channel includes a first channel and a second channel.

3. An apparatus for removing particles from a surface, comprising:

a manifold including a primary channel having a first opening facing the surface;

a secondary channel having a second opening facing the surface, said secondary channel including a first channel and a second channel, said secondary channel being parallel to the primary channel; said primary channel is between said first channel and second channel; and vacuum means, in communication with said primary and coating with said secondary channel, for generating high velocity air stream to disturb a boundary layer of the surface thereby removing adhered particles th surface.

4. An air suction manifold device for removal of fibers/debris from a photoconductive surface, comprising:

air manifold having a primary channel for supplying air to the photoconductive surface, a secondary channel, parallel to the primary channel, said secondary channel coating with said primary channel supplying a specific volume of air at a specific mean velocity in a direction perpendicular to the flow direction of the primary channel when a vacuum is applied to said primary channel, said secondary channel has flange having a sharp corner facing the surface.

5. The apparatus of claim 4, wherein said secondary channel includes a first channel and a second channel.

6. An air suction manifold device for removal of fibers/debris from a photo-conductive surface, comprising:

air manifold having a primary channel for supplying air to the photoconductive surface, a secondary channel, parallel to the primary channel, said secondary channel including a first channel and a second channel, said secondary channel coating said primary channel supplying a specific volume of air at a specific mean velocity in a direction perpendicular to the flow direction of the primary channel when a vacuum is applied to said primary channel, said primary channel is between said first channel and second channel.

7. A printer having an imaging member having an imaging surface, means for recording an image on the imaging surface and development system for developing the image, comprising:

an air suction manifold device for removal of fibers/debris from the imaging surface, comprising: air manifold having a primary channel for supplying air to the imaging surface, a secondary channel, parallel to the primary channel, said secondary channel coating with said primary channel supplying a specific volume of air at a specific mean velocity in a direction parallel to the flow direction of the primary channel when a vacuum is applied to said primary channel, said secondary channel has flange having a sharp corner facing the surface.

8. The apparatus of claim 7, wherein said secondary channel includes a first channel and a second channel.

9. The apparatus of claim 8, wherein said primary channel is between said first channel and second channel.

10. The apparatus of claim 7 wherein said air suction manifold device removes fibers prior to developing of said image.

* * * * *